US007688277B2

(12) United States Patent
Brocheton et al.

(10) Patent No.: US 7,688,277 B2
(45) Date of Patent: Mar. 30, 2010

(54) CIRCUIT COMPONENT AND CIRCUIT COMPONENT ASSEMBLY FOR ANTENNA CIRCUIT

(75) Inventors: Claude Brocheton, Voreppe (FR); Patrice Rigoland, Vancouver, WA (US); Serge Perrot, Rochester Hills, MI (US)

(73) Assignee: Radiall USA, Inc., Chandler, AZ (US)

( * ) Notice: Subject to any disclaimer, the term of this patent is extended or adjusted under 35 U.S.C. 154(b) by 582 days.

(21) Appl. No.: 11/587,106

(22) PCT Filed: Jun. 3, 2005

(86) PCT No.: PCT/US2005/019680

§ 371 (c)(1),
(2), (4) Date: Oct. 19, 2006

(87) PCT Pub. No.: WO2005/119841

PCT Pub. Date: Dec. 15, 2005

(65) Prior Publication Data

US 2008/0012788 A1 Jan. 17, 2008

Related U.S. Application Data

(60) Provisional application No. 60/577,283, filed on Jun. 4, 2004.

(51) Int. Cl.
*H01Q 1/50* (2006.01)

(52) U.S. Cl. ..... 343/850; 343/906

(58) Field of Classification Search ..... 343/850, 343/860–862, 702, 841
See application file for complete search history.

(56) References Cited

U.S. PATENT DOCUMENTS

| | | | |
|---|---|---|---|
| 3,523,251 | A | 8/1970 | Halstead |
| 5,811,972 | A | 9/1998 | Thompson et al. |
| 5,835,064 | A | 11/1998 | Gomez et al. |
| 5,867,127 | A | 2/1999 | Black et al. |
| 5,986,616 | A | 11/1999 | Edvardsson |

(Continued)

FOREIGN PATENT DOCUMENTS

EP 0 747 993 A 12/1996

OTHER PUBLICATIONS

"M/A-COM New Products," <http://www.macom.com/new_products/new_product_detail.asp?ID=368>, 1 page, accessed Jun. 28, 2004.

(Continued)

*Primary Examiner*—Huedung Mancuso
(74) *Attorney, Agent, or Firm*—Klarquist Sparkman, LLP

(57) ABSTRACT

A circuit component and circuit component housing assembly for use in an antenna circuit comprise a circuit component housing in which an interior space capable of receiving a circuit component is defined and a circuit component adapted to be received in the internal space. The housing also comprises a first contact capable of contacting a first portion of the received circuit component and a second contact capable of contacting a second portion of the received circuit component. The circuit component is adapted to be connected in series between the first contact and the second contact. The housing has at least one end configured with a coaxial-type connection adapted to connect the housing and the received circuit component in a circuit that includes an antenna.

29 Claims, 20 Drawing Sheets

U.S. PATENT DOCUMENTS

| | | | | |
|---|---|---|---|---|
| 6,016,431 | A | 1/2000 | Holshouser | |
| 6,043,781 | A * | 3/2000 | Toh et al. | 343/702 |
| 6,075,500 | A * | 6/2000 | Kurz et al. | 343/895 |
| 6,118,408 | A * | 9/2000 | Yang et al. | 343/702 |
| 6,488,512 | B2 | 12/2002 | Gonzales | |
| 6,563,469 | B2 | 5/2003 | Miyata et al. | |
| 6,654,595 | B1 * | 11/2003 | Dexter | 455/323 |
| 7,202,829 | B2 | 4/2007 | Lan | |
| 2001/0045916 | A1 | 11/2001 | Noro et al. | |
| 2004/0056812 | A1 | 3/2004 | Sabet et al. | |
| 2004/0209584 | A1 * | 10/2004 | Bargroff et al. | 455/180.1 |
| 2008/0012788 | A1 * | 1/2008 | Brocheton et al. | 343/906 |

OTHER PUBLICATIONS

Second Office Action by the European Patent Office for corresponding European Patent Application No. 05 758 051.6 (which is a regional stage application of PCT/US05/19680, the present application being a national stage application of PCT/US05/19680), issued Aug. 11, 2009, 7 pp.

Supplementary European Search Report for European Patent Application No. EP 05 75 8051; 4 pp. (Jun. 20, 2008).

* cited by examiner

| | Antenna 1 | |
|---|---|---|
| % of Bandwidth | w/o matching network | w/ matching network |
| | (2.5 " long) | (2.9 " long) |
| | | |
| VSWR ≤ 2.0:1 | 6% | 12% |
| | | |
| Gain (-3 dBi) | 7% | 8% |
| | | |

Fig. 43

| | Antenna 2 | |
|---|---|---|
| % of Bandwidth | w/o matching network | w/ matching network |
| | (3.5" long) | (4.5 " long) |
| | | |
| VSWR ≤ 2.0:1 | 9% | 25% |
| | | |
| Gain (-3 dBi) | 11% | 17% |
| | | |

Fig. 44

CIRCUIT COMPONENT AND CIRCUIT COMPONENT ASSEMBLY FOR ANTENNA CIRCUIT

CROSS REFERENCE TO RELATED APPLICATIONS

This is the U.S. National Stage of International Application No. PCT/US2005/019680, filed Jun. 3, 2005, which was published in English under PCT Article 21(2), which in turn claims the benefit of U.S. Provisional Patent Application No. 60/577,283, filed Jun. 4, 2004. Both applications are incorporated herein in their entirety.

RELATED APPLICATION

This application claims the benefit of U.S. Provisional Patent Application 60/577,283 filed Jun. 4, 2004, which is incorporated herein by reference.

FIELD

This application relates to antennas, and more specifically to a circuit component and circuit component housing designed for use in an antenna circuit.

BACKGROUND

In the design and specification of an antenna for any particular device, the antenna must often be adapted for use with the device. A properly adapted antenna allows the device to perform at its optimum level for given operating conditions.

One such type of "adaptation" is antenna matching or impedance matching, which is the process of adjusting the antenna's input impedance to be approximately equal to the characteristic impedance of the RF system over a specified range of frequencies. Assuming that the device is also designed or tuned to have an impedance approximately equal to the characteristic impedance, the antenna will be matched to the device.

Antenna matching is often achieved using a circuit containing one or more capacitors, resistors, inductors and possibly other lumped or pseudo-localized (transmission line, open or short circuit stub) components arranged in a network. These components and their characteristics are selected such that the output of the matching circuit when connected to the antenna has an impedance as seen from the device that is approximately equal to a desired impedance, e.g., the characteristic impedance.

A matching circuit is usually enclosed within the device, either as a separate element or as part of another circuit in the device. Before the design of the device is fixed, it is usually possible to accommodate the matching circuit. As devices that require antennas continue to decrease in size, however, internal space within the devices is very limited.

Most matching circuits are designed for a particular antenna and for a particular device. To use the antenna with a different device, or to use the device with a different antenna, a different matching circuit must be developed and substituted within the device. Making such a substitution may not be possible. Even if it possible, it may be difficult to access the existing matching circuit.

In the case of existing devices, there may be situations where an antenna needs to be added to a device that was designed without one. It may be necessary to replace an original antenna that is no longer available with a substitute model. Even if a replacement is available, it may exhibit slight differences in performance than the original. Any one of these factors, or a change in the device itself, may require that the antenna be re-adapted to the device.

One conventional type of antenna used in many applications is a whip antenna. A whip antenna has an elongated configuration, which may be rigid or resilient, and is attached at one end to the device. The attached end has a device interface for physically coupling the antenna and electrically connecting it to the device. Many conventional device interfaces are of the coaxial cable-type connection with a central wire or conductor surrounded by insulation, which in turn is surrounded by a grounded shield. Such conventional interfaces include SMA (Semi-Miniature A), stud, BNC (Bayonet Neil-Concelman) and many others.

It would be desirable to provide a methodology and structure for allowing flexible adaptation of antennas for use with different kinds of devices. It would be desirable to provide a solution for adapting a given antenna to a number of different devices without requiring changes to the dedicated circuitry enclosed within the device. It would also be desirable to provide a solution for reconfiguring certain conventional antennas to allow adaptation for different uses. It would also be desirable to provide a connector for applications other than antennas that is highly adaptable.

SUMMARY

Disclosed below are representative embodiments that are not intended to be limiting in any way. Instead, the present disclosure is directed toward novel and nonobvious features, aspects, and equivalents of the embodiments of the circuit component and circuit component housing described below. The disclosed features and aspects of the embodiments can be used alone or in various novel and nonobvious combinations and sub-combinations with one another.

According to some implementations, a circuit component and circuit component housing assembly for use in an antenna circuit comprise a circuit component housing in which an interior space capable of receiving a circuit component is defined and a circuit component adapted to be received in the internal space. The housing also comprises a first contact capable of contacting a first portion of the circuit component and a second contact capable of contacting a second portion of the circuit component. The circuit component is adapted to be connected in series between the first contact and the second contact. The housing has at least one end configured with a coaxial-type connection adapted to connect the housing and circuit component in a circuit that includes an antenna. Examples of coaxial-type connections include but are not limited to SMA, stud and BNC.

The housing may be adapted to be a part of a connector, and the end configured with a coaxial-type connection, i.e., the first end, can be configured for coupling to a device, e.g., a radio. The other end, i.e., the second end, can be configured for removably coupling the connector to an antenna.

Alternatively, the housing may be adapted to be part of an antenna assembly, which can also be referred to as a connector integrated with an antenna element. In this implementation, the first end of the housing is configured for coupling to a device, and the second end is connected to an antenna element.

Alternatively, the housing may be configured for placement within the device with the at least one end having the coaxial-type connection positioned at or protruding from the exterior surface of the device. In this way, the circuit component and the housing can be coupled to a corresponding coaxial-type connection external to the device that leads to an antenna.

The circuit component can include one or more of the following: an antenna matching circuit, an amplifier circuit, an attenuator circuit, a splitter circuit, a diplexer circuit, a filtering circuit, etc. Antenna matching circuits may provide for passive and/or active impedance matching.

The circuit component can include at least a portion configured as an integrated circuit. The circuit component can include at least a portion configured as a printed circuit board. Other types of circuit designs can also be used.

The first contact can be a socket contact dimensioned to receive a center conductor of a corresponding coaxial cable. The at least one end can comprise a first connector portion radially spaced from the first contact, the first connector portion defining an outer periphery of the at least one end.

The first connector portion can be electrically isolated from the first contact. An insulator can be positioned radially between the first contact and the first connector portion.

The second contact can have an inner end shaped to contact the circuit component and an outer end adapted to couple to an antenna element. The outer end of the second contact can have threads adapted to receive a helical-shaped antenna element.

The second contact can be electrically isolated from the first contact except for an electrical connection to the first contact established through the circuit component when the circuit component is assembled in series between the first contact and second contact.

The assembly can include a separate electrical connection between the circuit component and an electrical ground within the assembly. The separate electrical connection can be a conductive spring contact shaped to establish electrical contact with the circuit component and to assist in holding the circuit component in place in the interior space.

In some implementations, the first and second contacts comprise soldered connections to the circuit component. In other implementations, no soldered connections are used, and the circuit component can be installed in and removed from the housing without the use of a tool The housing can be adapted to be a part of a connector, in which the at least one end of the housing is a first end and is configured for coupling to a device. The first contact can be a socket contact with an outer end positioned adjacent the first end of the housing and dimensioned to receive a center conductor of a corresponding coaxial-type connection leading to a device. The second end of the housing can have a coaxial-type connection, and the second contact can be a socket contact with an outer end positioned adjacent the second end and dimensioned to receive a center conductor of a corresponding coaxial-type connection leading to an antenna. The connector can have a generally elongated shape and a generally circular cross section.

The circuit component can include at least one capacitor. The circuit component can include at least one coil. The circuit component can have ends shaped to receive the first contact and the second contact.

The coaxial-type connection of the first end can comprise an edge card interface for coupling the assembly to an edge of a card.

The first contact can have a central bore shaped to receive a conductor of a coaxial cable that can be extended to contact the circuit component within the housing.

According to other implementations, an assembly can comprise a body having first and second ends and a generally enclosed exterior surface extending between the two ends, wherein at least the first end comprises a coaxial-type connection with a first contact generally aligned with an axis of the body and a first outer portion radially spaced from the first contact, the coaxial-type connection allowing the assembly to be coupled to a corresponding coaxial-type connection of a device or cable, a circuit component received in an internal space defined within the body, the circuit component having electrical connections to the first end by the first contact and to the second end, and a ground connection between the body and the circuit component by which the circuit component is grounded. The assembly can also comprise a hollow tubular insulator configured to fit within the body between the first outer portion and the first contact, the internal space comprising a generally axial slot formed in the insulator, and the insulator having a side surface in which an opening for the ground connection from the circuit component to the body is defined.

In some embodiments, the circuit component and housing are part of a connector used to connect one element (e.g., an antenna) to another element (e.g., in the case of an antenna, to a device such as radio or other similar device). The circuit component is "built-in" to the connector, i.e., it is internal to the connector and designed to be positioned in the connector. In other embodiments, the circuit component is "built-in" to an antenna assembly or into a device. Typically, the circuit component is positioned within the general overall periphery of the connector, the antenna assembly or the device.

In particular embodiments, the circuit component is removable from the connector, and can be considered to be a modular component of the connector. A removable circuit component allows for easy substitution of a different circuit component, replacement of a faulty or damaged circuit component, easy testing of the device without a circuit element, etc. In particular embodiments, the circuit component is removable from the connector by hand, i.e., without the use of tools.

BRIEF DESCRIPTION OF DRAWINGS

FIG. 43 is a table graph of frequency vs. Delta for the defined quantities Delta VSWR and Delta Gain.

FIG. 44 is a graph of frequency vs. VSWR for a specific antenna in two configurations.

DETAILED DESCRIPTION

Figure 1:
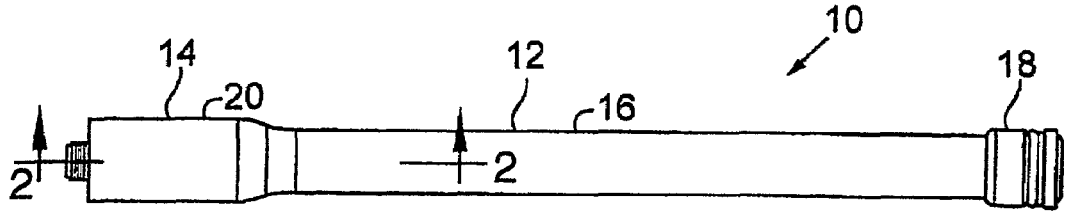
FIG. 1 is a side view showing an embodiment of an antenna assembly that includes an antenna, an integrated antenna connector and a circuit component.

Described herein are various embodiments of a built-in circuit component for use with an antenna, such as for adapting the antenna for use with a particular device (e.g., a circuit component that has an antenna matching circuit). The circuit component can be "built-in" to an antenna assembly, an antenna connector or a device to which the antenna and/or antenna connector are coupled. Typically, such a "device" is an electronic device requiring an antenna to send and/or receive signals, e.g., a radio.

The "antenna assembly" as used herein refers to the external antenna of an electronic device (which is also known as simply an "antenna") and typically includes at least an antenna element and a connection for coupling the antenna assembly to a device or a conductor leading to a device. One non-limiting example of an antenna assembly is a whip antenna.

The connector refers to a component that is typically installed between the device and the antenna, and has respective connections to each of these other components (or to conductors that lead to these components). In some embodiments, the connector allows quick coupling and decoupling to the antenna and to the device. In other embodiments, the connector is integrated within the antenna assembly.

The circuit component can be housed, or at least partially housed, generally within the periphery of the antenna assembly, generally within the periphery of the connector or generally within the periphery of the device. Thus, one or more elements of the structure generally surrounding or lying outside of the circuit component in the antenna assembly, in the connector, or in the device can be referred to as the circuit component housing.

Advantages of the various embodiments include but are not limited to the following:

- Connector
  - Reduces the RF interference in the radio introduced by the creation of a matching circuit between the antenna and the radio (because the circuit component is shielded by the structure of the connector or antenna).
  - Simplifies the interconnection between the antenna and the radio card (eases assembly process, reduces the number of components, makes the overall physical construction more rugged, etc).
  - Simplifies the matching of the antenna to the particular device or application (easy to implement and test).
  - Allows introduction of various types of custom interfaces in terms of mechanical and electrical characteristics (custom output impedance, custom external interface, etc.).
  - Provides a low cost solution in the case of the customization or the creation of a new design for an antenna and/or a device.
- Antenna assembly with connector having built-in circuit component
  - Improves the bandwidth in terms of impedance of any type of portable antenna.
  - Improves the out of band rejection of the antenna with no important effect on the efficiency.
  - Matches a higher mode resonance allowing use of the antenna as a multi-band solution.
  - Introduces any type of custom interface in terms of mechanical and electrical characteristics (custom output impedance, custom external interface, etc.).
  - Provides a cost effective solution in the case of the customization or the creation of a new design for an antenna and/or a device.
  - Simplifies the matching of the antenna to a particular application (easy to implement and test).

Figure 2:
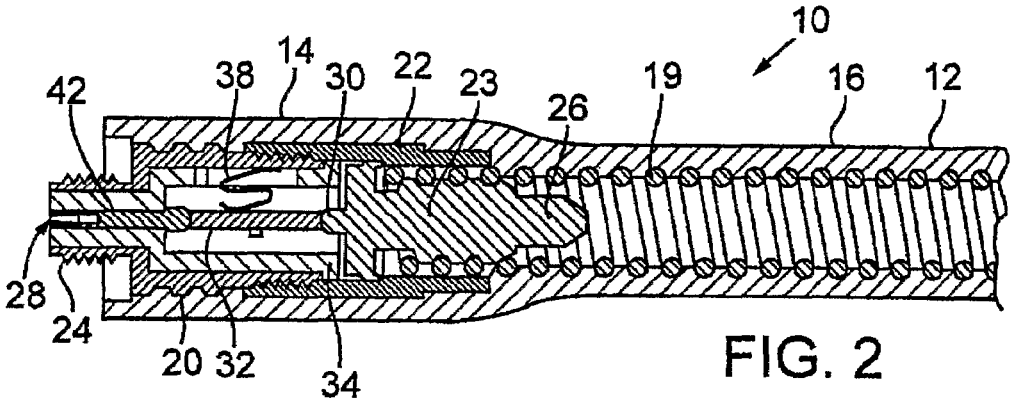
FIG. 2 is a sectioned side view of a portion of the antenna assembly of FIG. 1 showing the connector, including a first portion extending from the left end, a second portion that is connected to the antenna element and the circuit component positioned between the first and second portions.

Referring to the figures, FIG. 1 shows an embodiment of an antenna assembly 10 that includes an antenna 12 and an integrated antenna connector 14 with a built-in circuit component 32 (FIG. 2). In this embodiment, the antenna 12 and connector 14 are covered by an over-molded sleeve. The antenna 12 is similar in overall configuration to a conventional whip antenna, e.g., as used with devices for radio communication. In this embodiment, the antenna 12 has a generally cylindrical antenna body 16 that terminates at an end, such as an end 18 provided with a whip cap as shown in FIG. 1.

FIG. 2 is an enlarged sectional view of the connector 14 and a portion of the antenna 12 of FIG. 1. Within the exterior sleeve, the connector 14 includes a first portion 20 terminating in a first end 24 at the left of the figure, and a second portion 23 terminating at a second end 26 opposite the first end 24. The second portion 23 is coupled to an antenna element 19, such as by the thread-like engagement as shown.

The first portion 20, also called the connector body, and the second portion 23, also called the pin, are electrically isolated from each other, such as by an insulator 34. The connector body 20 and the pin 23 can be maintained in a fixed position relative to each other within the connector 14, such as by a threaded cover 22 or other coupling member that couples the connector body 20 and the pin 23 together. At its left end, the pin 23 has an inner contact 30 that establishes electrical contact with one end of the circuit component 32.

At the first end 24 of the connector body 20, a device interface 28 is defined for establishing an electrical connection between the connector 14 and a device, either directly or via a cable extending to or from that device. In the illustrated embodiment, the device interface 28 is configured for a coaxial-type connection, with the first end 24 of the connector body 20 defining a surrounding outer conductor, and includes a socket-type contact 42 positioned generally along a central axis of the first end 24 and defining an inner conductor separate from the outer conductor. The contact 42 extends inwardly to establish an electrical connection with the other end of the circuit component 32 as shown. Other types of interfaces, some of which are described below, can also be used.

The insulator 34 can extend along the length of the connector body 20 as shown to electrically isolate the contact 42 and the circuit component 32 from the connector body 20. In the illustrated implementation, the insulator 34 also supports the contact 42 within the first end 24.

Figure 9:
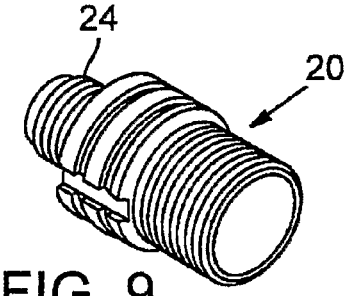
FIG. 9 is a perspective view of the first portion of the connector.
Figure 10:
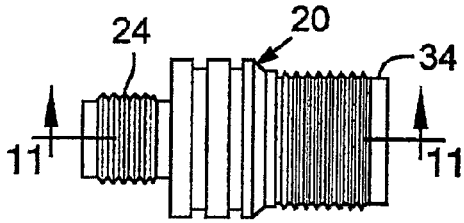
FIG. 10 is a side view of the first portion of the connector.
Figure 11:
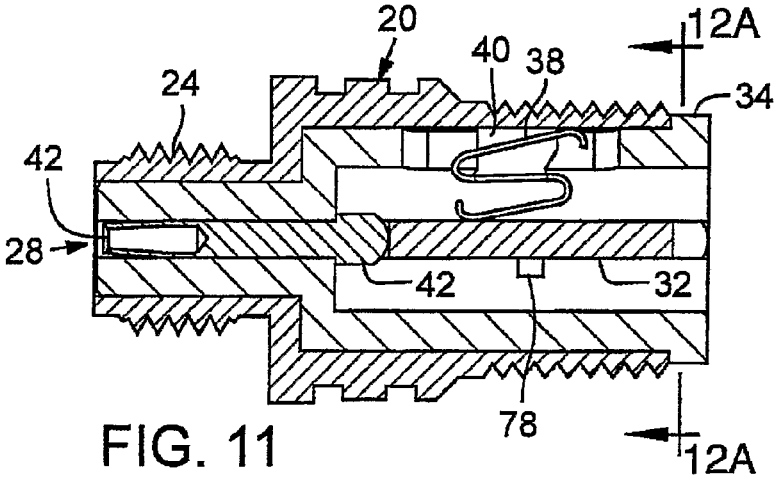
FIG. 11 is an enlarged sectioned view of FIG. 10.

FIG. 9 is a perspective view of the connector body 20. FIG. 10 is a side view of the connector body 20 with the insulator 34 installed. FIG. 11 is an enlarged sectioned view of the connector body 20 and the insulator 34 of FIG. 10, similar to FIG. 2.

Figure 12A:
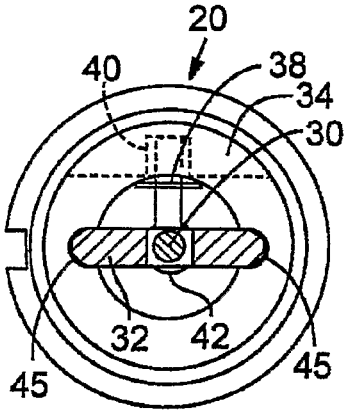
FIG. 12A is an end view of the first portion connector body showing the circuit component held in place by a spring contact.
Figure 12B:
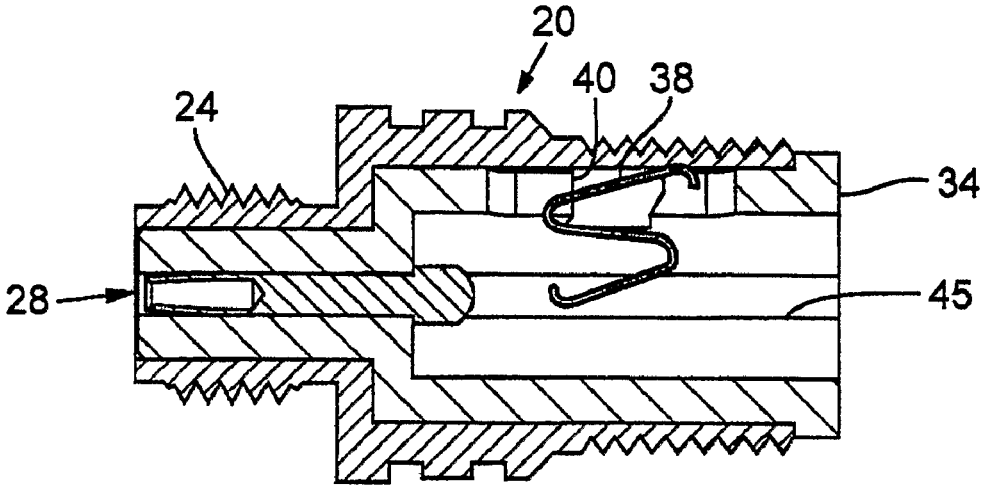
FIG. 12B is an end view of the connector similar to FIG. 12A, except with the circuit component removed.

Referring to FIG. 11, there is an opening 40 in the side of the insulator 34 allowing an electrical connection between a side of the circuit component 32 and the connector body 20, which is ground, via a spring contact 38. The spring contact 38 also exerts a biasing force against the circuit component 32 to assist in holding it in place when the threaded cover 22 and pin 23 are removed to access it. FIG. 12A is a right end view showing the circuit component 32 in place, with its side edges received in grooves 45 formed in the insulator 34. Thus, the circuit component 32 is fitted within the periphery of the connector 14. FIG. 12B is similar to FIG. 11, except the circuit component 32 has been removed.

Figure 3:
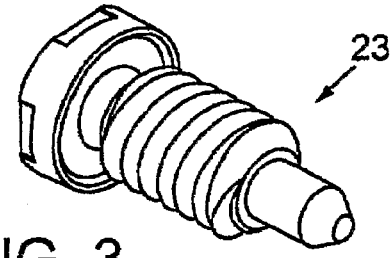
FIG. 3 is a perspective view of the second portion of the connector of FIG. 2.
Figure 4:
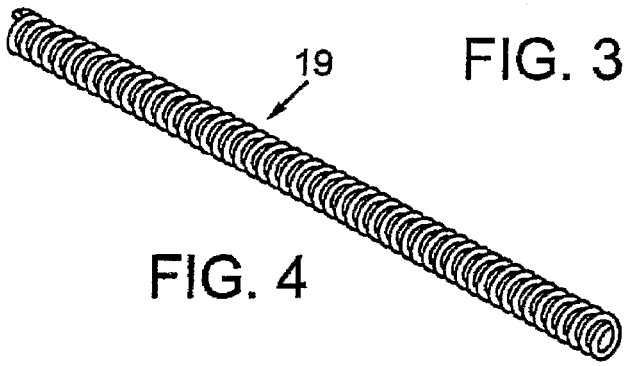
FIG. 4 is a perspective view of the antenna element.
Figure 5:
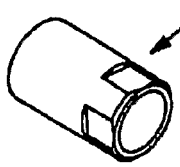
FIG. 5 is a perspective view of a threaded cover of the connector.
Figure 6:
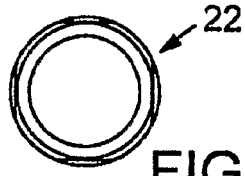
FIGS. 6, 7 and 8 are end, side and sectioned side views, respectively, of the threaded cover.
Figure 7:
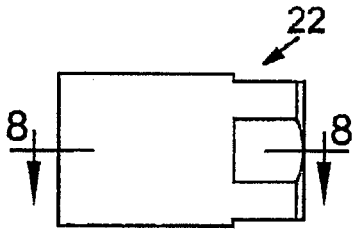
Figure 8:
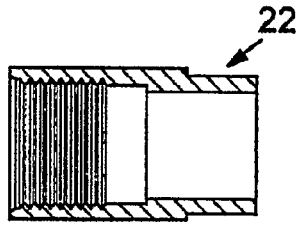

FIG. 3 shows a perspective view of the pin 30. As shown in FIG. 4, the antenna element 19 can be a helical-shaped member formed of a conductive material. FIGS. 5-8 show additional views of the threaded cover 22.

Figure 14:
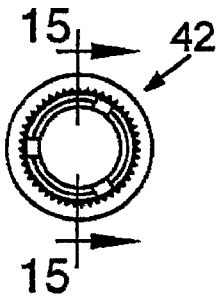
FIG. 14 is an end view of the left end of the center socket contact of FIG. 13.
Figure 13:
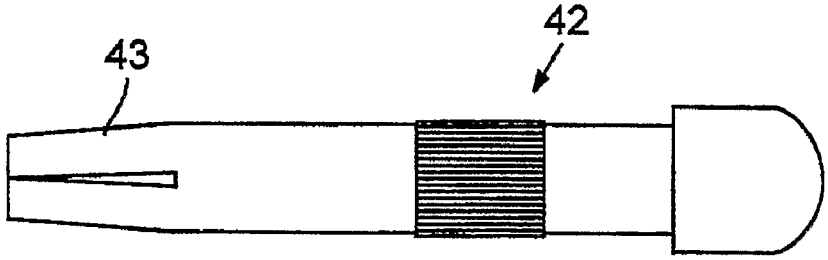
FIG. 13 is a side view of the center socket contact.
Figure 15:
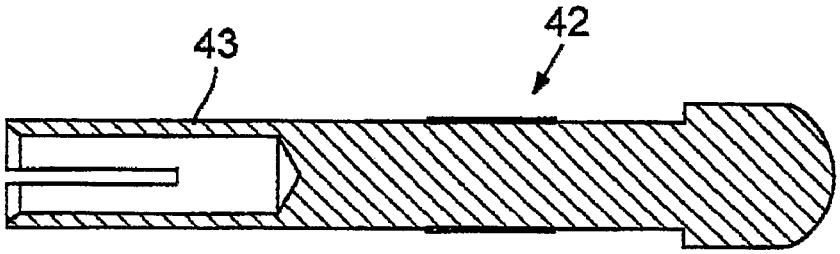
FIG. 15 is an enlarged sectioned view of the center socket contact before the end is crimped.
Figure 16:
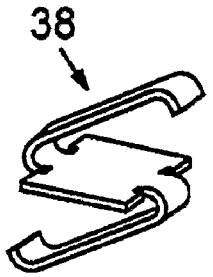
FIG. 16 is a perspective view of the spring contact.
Figure 18:
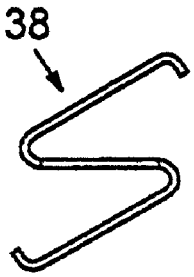
FIGS. 17, 18 and 19 are front, side and top views, respectively, of the spring contact of FIG. 16.

FIGS. 13-15 are additional views of the center socket contact 42. As best shown in FIGS. 14 and 15, the contact 42 can have a socket 43 defined in one end that can be crimped to form a tapered nose as shown in, e.g., FIG. 13.

Figure 20:
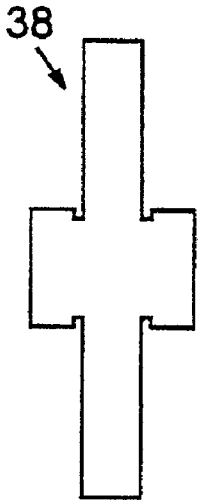
FIG. 20 is a plan view of a pattern for the spring contact.
Figure 17:
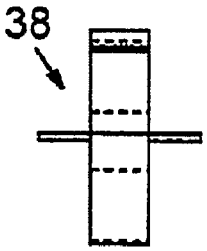
Figure 19:
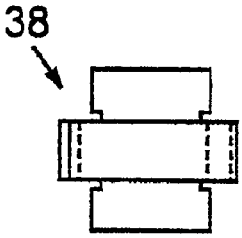
Figure 21:
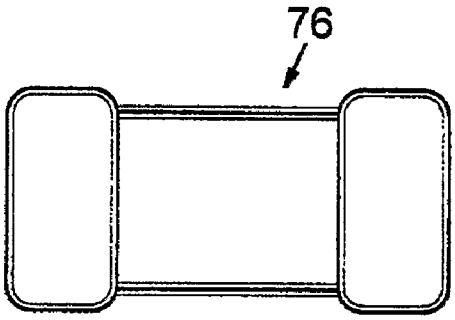
FIGS. 21 and 22 are side and end views, respectively, of the capacitor.
Figure 22:
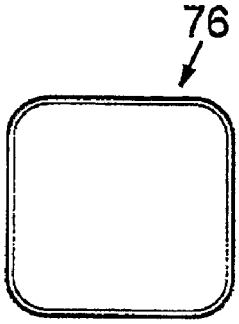
Figure 23:
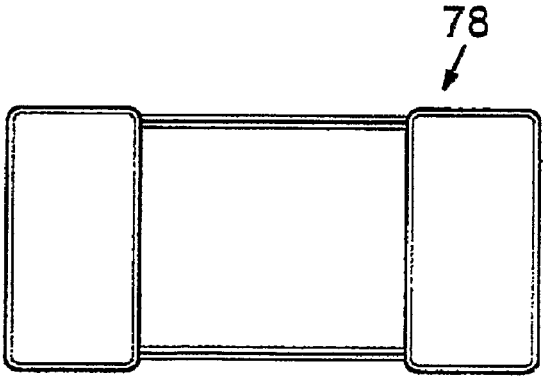
FIGS. 23 and 24 are side and end views, respectively, of the coil.
Figure 24:
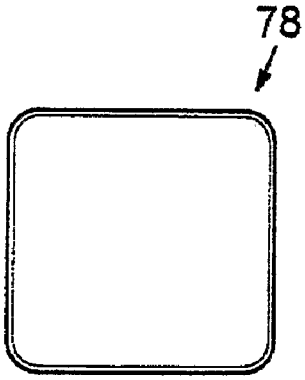
Figure 25:
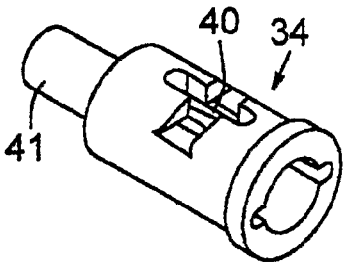
FIG. 25 is a perspective view of the insulator.
Figure 26:
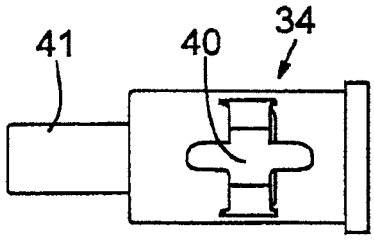
FIG. 26 is a top view of the insulator of FIG. 25.
Figure 27:
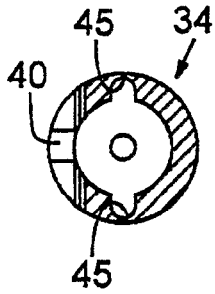
FIG. 27 is a sectioned view of the insulator of FIG. 26.
Figure 28:
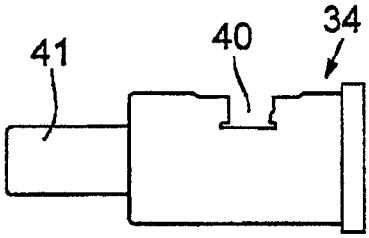
FIG. 28 is a side view of the insulator of FIG. 26.
Figure 29:
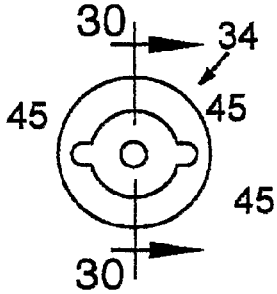
FIG. 29 is an end view of the insulator of FIG. 28.
Figure 30:
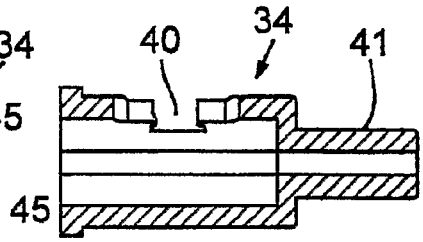
FIG. 30 is a sectioned side view of the insulator taken along the line 30-30 in FIG. 29.

FIGS. 16-20 are additional views of the spring contact 38. FIGS. 16-19 show the spring contact configured in its formed shape and in a relaxed state. FIG. 20 shows the spring contact 38 in a flattened state, e.g., as it would appear after being cut from a piece of sheet stock.

As discussed above, the illustrated embodiment has a device interface 28 for a coaxial cable-type connection, and specifically, an SMA connection. Other types of conventional or custom connections could be used. For example, there could be a connection methodology having a mode that allows it to be locked against simple removal for production, and another mode in which it is simply removable, for example, during design and testing. Of course, any other suitable type of device interface for allowing ready connection of the connector to the device could be used.

As shown in FIGS. 25-30, the insulator 34 is a generally cylindrical insulator and has a hollow interior defining a space to receive the circuit component 32. Edges of the circuit component can be received in the grooves 45 formed in the inner surface of the insulator. As shown, e.g., in FIG. 28, the insulator 34 can have a stepped extension 41 of smaller diameter shaped to be received within the portion of the connector body adjacent the first end and having a smaller diameter.

In some embodiments, the circuit component 32 can be removed by hand, without the use of tools, to allow use and/or testing of the antenna system 10 without the circuit component, to replace the circuit component 32 or to substitute a different circuit component 32. In other embodiments, the circuit component is generally not as easily removable.

Figure 31:
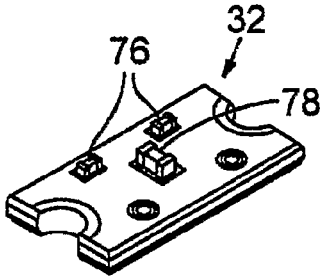
FIG. 31 is a perspective view of the circuit component.
Figure 32:
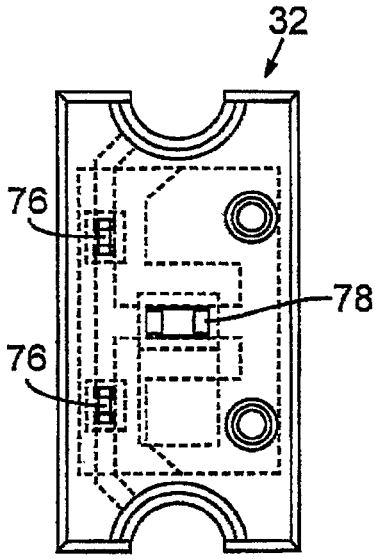
FIG. 32 is a top view of the circuit component of FIG. 31.
Figure 33:
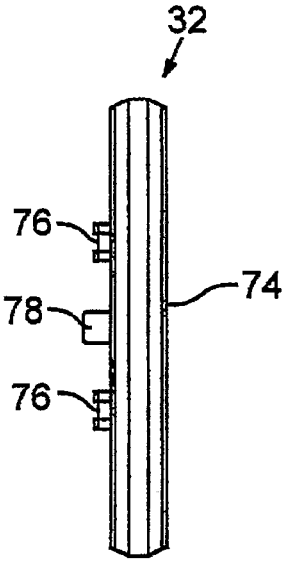
FIG. 33 is a side view of the circuit component of FIG. 31.

The circuit component 32 is best shown in FIGS. 31-33. As best shown in FIG. 32, the circuit component 32 can have features to facilitate making electrical contact with other components, such as the curved notches 72 that receive the head of the contact 42 and the inner contact 30.

Figure 51:
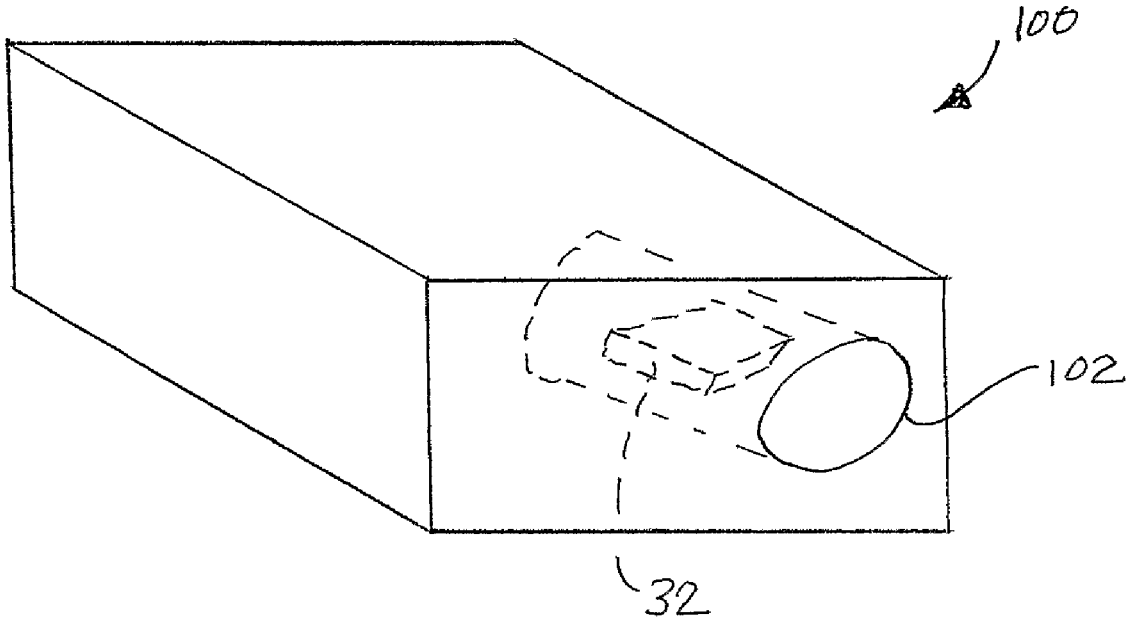
FIG. 51 is a schematic representation of a circuit component and housing configured for placement generally within the periphery of a device.

As shown in FIG. 51, a device 100 can be provided with the built-in circuit component 32. The device can have a connection 102, which typically is a coaxial-type connection. The connection 102 can be positioned substantially within the device 100 as shown, or it may protrude slightly from the surrounding exterior surface of the device 100. The connection 102 is configured to allow the device 100 to be coupled to an antenna assembly, either directly or with an intervening cable and/or connector. At the other end of the circuit component housing, there is a connection to the device circuit, e.g., to the radio card if the device 100 is a radio.

In the illustrated embodiments, the circuit component 32 includes a matching circuit. Referring to FIG. 33, there is a contact portion 74 on a first side of the circuit component 32 by which it makes electrical contact with the spring contact 38. On a second side as shown in FIG. 31-33, there are circuit elements, which, for this example of a matching circuit, include two capacitors 76 interconnected with a coil 78. In this example, the capacitors 76 each have a capacitance of 10 pF, and the coil 78 has an inductance of 10 nH. Additional views of the capacitors and coil are shown in FIGS. 21-22 and FIGS. 23-24, respectively. The location of the coil 78 in the assembled connector can also be seen in FIGS. 2 and 11.

In addition to or instead of a matching circuit, the circuit component 32 can be configured for other adaptation or device specific functions. For example, the circuit component can be configured to include filters, such as low-pass, high-pass and/or other types of filters. Such filters can be passive filters or active filters. The circuit component can be configured to have an amplifier circuit and/or an attenuator circuit. Also, the circuit component can have a diplexing circuit or a splitter circuit. Of course, it is also possible to include circuits having other functions, as would be known to those of skill in the art.

As is also well known, it is also possible to configure the circuit component or portions of it to be turned off depending upon the particular operating requirements of the attached device and/or antenna. Thus, the circuit component could comprise multiple circuits, e.g., multiple different matching circuits, where at least one of the circuits is unused in a particular installation.

To provide efficient solutions for the realization of wide-band antennas for portable applications, a new innovation of a low cost technical advance that allows the integration of a matching structure at the base of the antenna, integrated into the connector assembly, or integrated into the device connection, has been developed.

This advance has been developed in order to increase the bandwidth of classical low frequency (VHF, UHF) structures as whip and helical antennas in a more compact size. Indirectly, this advance has also been developed in order to propose a ruggedized, low form factor and quickly assembled matching component for portable applications. As this advance can be applied to any kind of circuit, including matching circuits, filter circuits, splitter circuits and other types of circuits, one or more of the following advantages may be achieved:

Wide-band matching for antenna applications.

Control of the out of band rejection and reduction of spurious.

Multi-band matching for antenna applications.

Low cost mass production

Highly repeatable & robust production processes

Smaller length and physical mass

Greater flexibility in portable type antennas.

Active circuit components can also be integrated, which extends the advance to amplified or adaptive portable antennas.

In the past, it has been necessary to optimize the radiation efficiency and VSWR of stub antennas integrated in different type of terminals from stud to barcode readers. Once approach to this type of problem is the integration of a matching network between the antenna and the radio.

At this time, one solution to implement this type of circuit in a very dense environment is to use an adhesive flex circuit (Kapton, polyester films, or the like). For electrical and manufacturing reasons, these types of circuits appear to be very difficult to implement without creating numerous problems such as:

RF interference in the radio: increase of spurious, loss of efficiency, etc.

Parasitic radiation and coupling effects.

Critical mounting procedure: no consistency, high scrap rate and time consuming.

Figure 38:
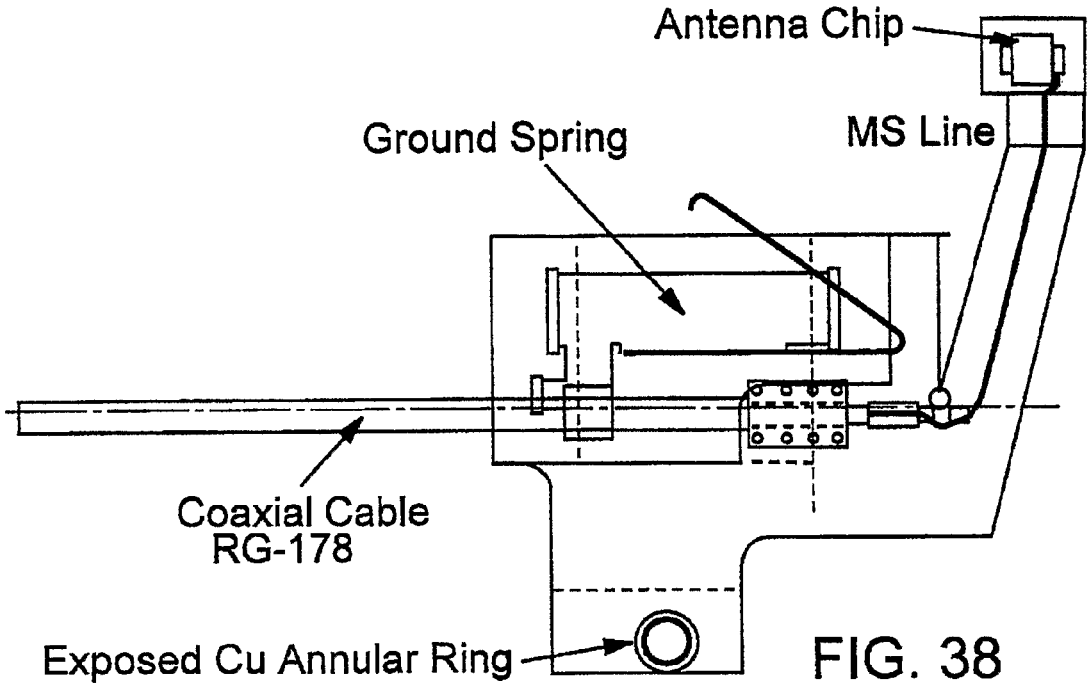
FIG. 38 Prior Art
FIG. 38 is a plan view of a conventional antenna matching circuit that is installed separate from the antenna.

FIG. 38 shows a common matching circuit for a handheld radio application configured in a flex circuit, separate from the antenna.

Matching circuits such as the one shown in FIG. 38 are most always custom-made for a specific application, and offer no flexibility in terms of design. In addition, in most cases, the realization of a matching structure will add as much as 10 parts to the bill of materials.

For example, with reference to the circuit in FIG. 38, the interconnection between the antenna and the RF card could include: 2 metallic clips (requiring use of 2 forming tools), 1 flex circuit, 1 FR4 stiffener, 1 cable assembly, 1 miniature connector, 1 antenna connector and several lumped components, which may be an unnecessary proliferation of components.

In contrast, the circuit component 32 in the connector 14 and/or the device 100 is optimized electrically as well as mechanically. A "no solder" manufacturing process and a versatile design reduce the cost of the components and also allow simple electrical design. Alternatively, the FIG. 51 approach of integrating the built-in circuit component within the device As will be apparent to those of skill in the art, a complete family of connectors to offer customized solutions is possible. The connector can be provided with commercial radio cards, which allows the design engineer to optimize the antenna to the radio card application by using the matching network. It is feasible to develop this connector with any common or custom interface, including, for example:

Any type of interface: SMA, BNC, STUD, etc

Any type of termination: SMT (Surface Mount Technology), Edge card, Cable mounting, etc.

Figure 34:
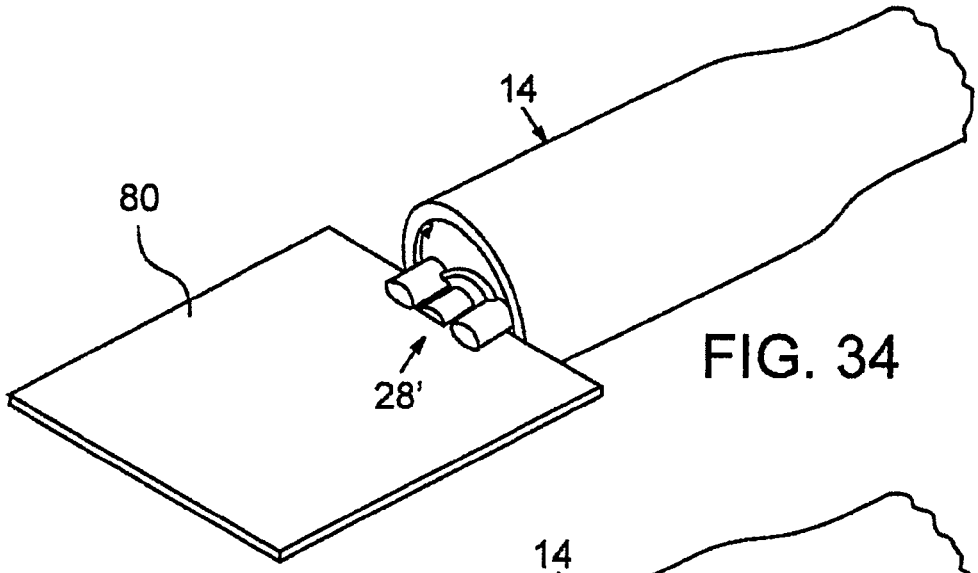
FIGS. 34 and 35 are perspective views of an alternative embodiment showing the connector configured for mounting in an edge card-type mounting application.
Figure 35:
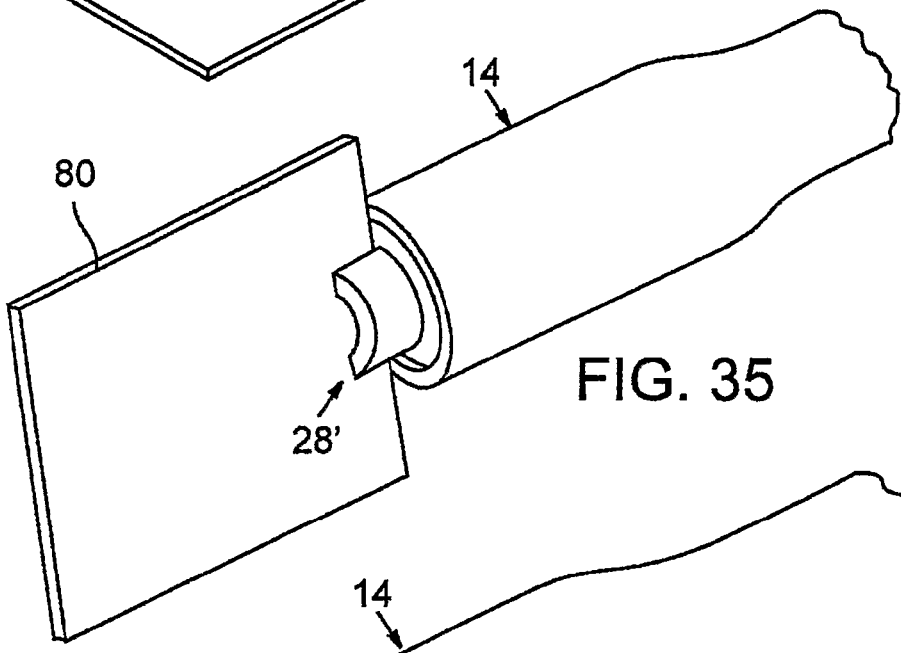

An exemplary edge card mounting for the connector 14 is shown in FIGS. 34 and 35. An edge card interface 28' of the connector 14 is shown connected to an edge of a card 80.

Figure 36:
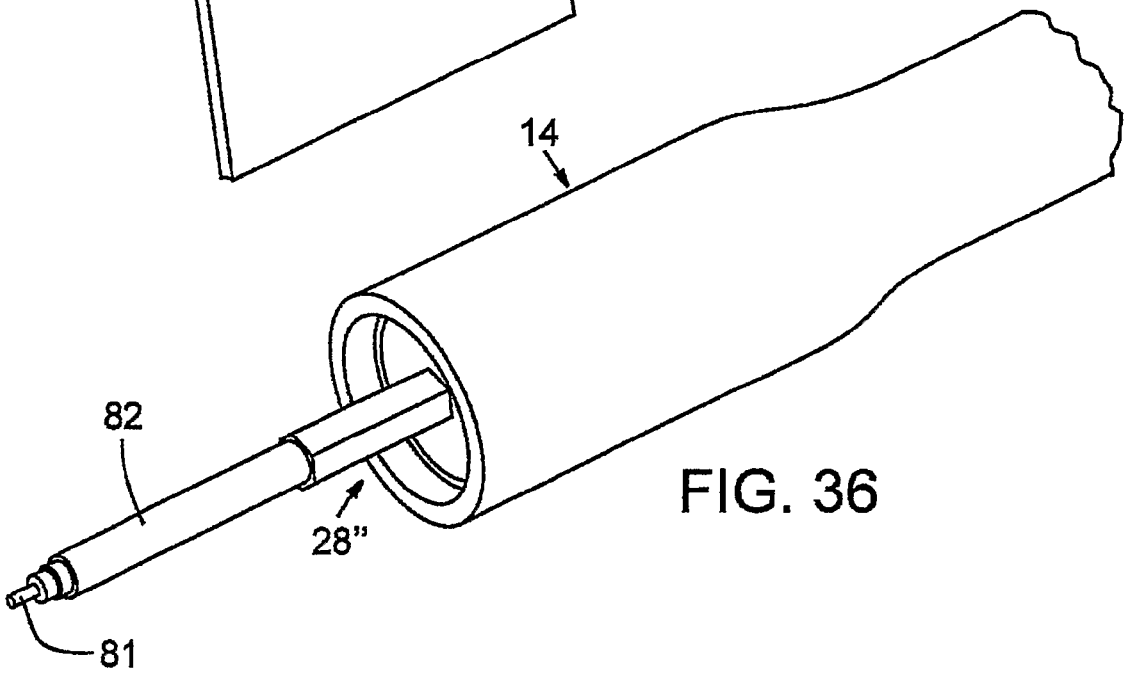
FIG. 36 is a perspective view of an alternative embodiment of the connector configured for cable assembly-type mounting.
Figure 37:
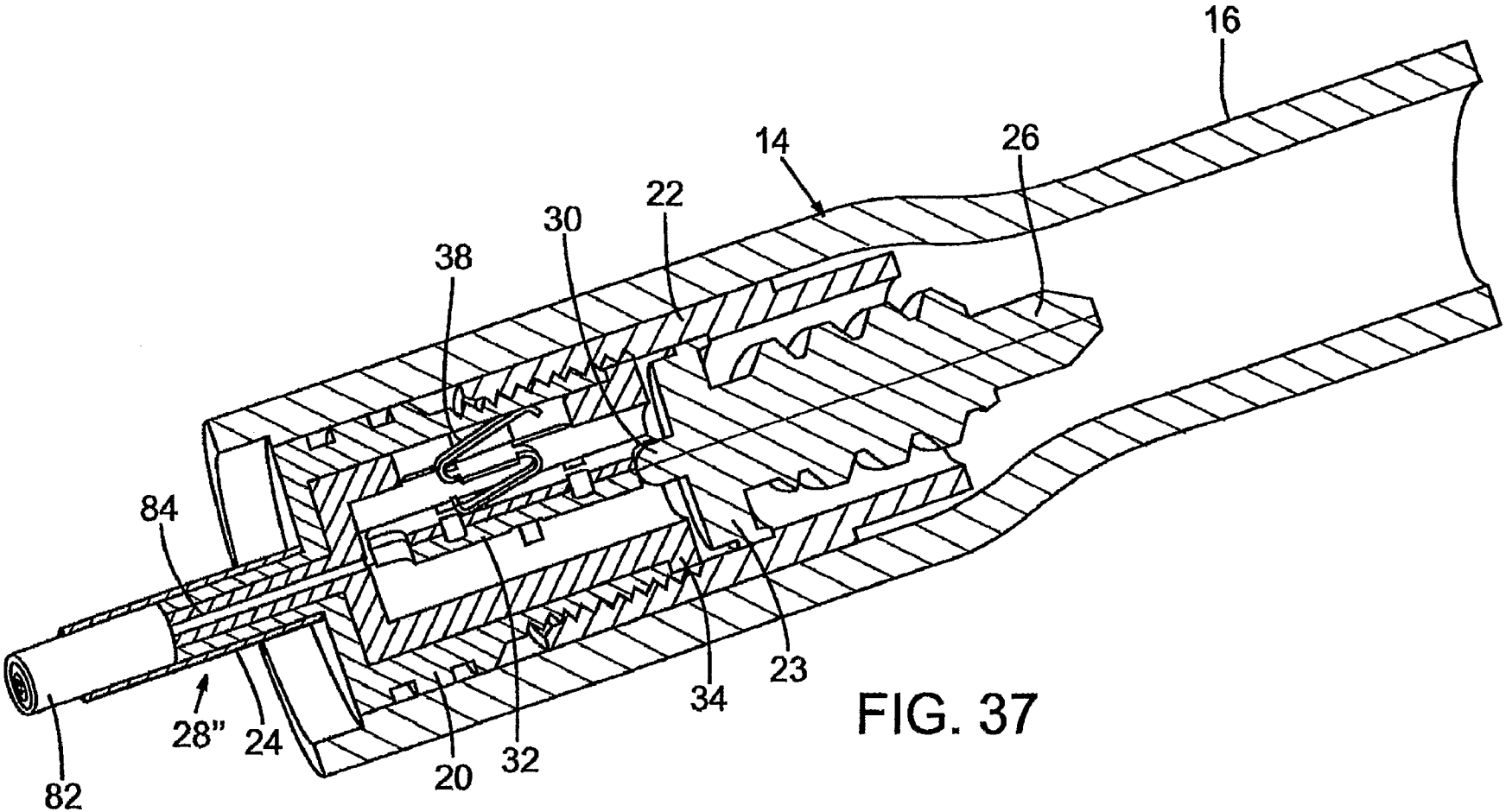
FIG. 37 is a sectioned perspective view of the embodiment shown in FIG. 36.

FIGS. 36 and 37 show an alternative interface 28" for a cable mounting approach in which the inner conductor 81 of an attached cable 82 extends to contact the circuit component 32 (and thus the contact 42 is not required). Although not shown in FIG. 37, the inner conductor 81 would extend through a bore 84 in the insulator 34 to contact the circuit component 32, replacing the contact 42.

Among other applications, the connector 32 can be used to facilitate the final tuning of the antenna element. One methodology for creating a matching network includes the following steps:

Step 1: Measure the antenna element without a matching network (i.e., substitute a single microstrip line for the circuit component in the connector) and extract the S parameters of the antenna.

Step 2: Import the S parameters into a circuit simulator.

Step 3: Optimize the filter topology with the antenna.

Step 4: Create and install the matching network.

Step 5: Measure the assembly.

At this time, due to the shielding provided by the connector, the correlation between simulation and measurement has been nearly ideal and no additional steps of tuning have been necessary on the first prototypes realized with this configuration. An exemplary matching circuit developed for a 4.5 inch wide-band antenna in the UHF frequency band is shown schematically in FIG. 39.

Figure 39:
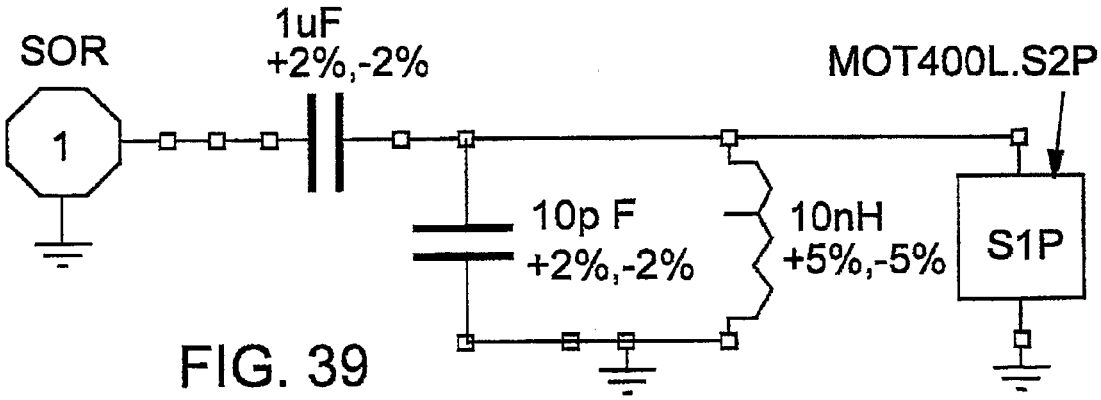
FIG. 39 is a schematic of an antenna matching circuit using the connector with the circuit component.
Figure 40:
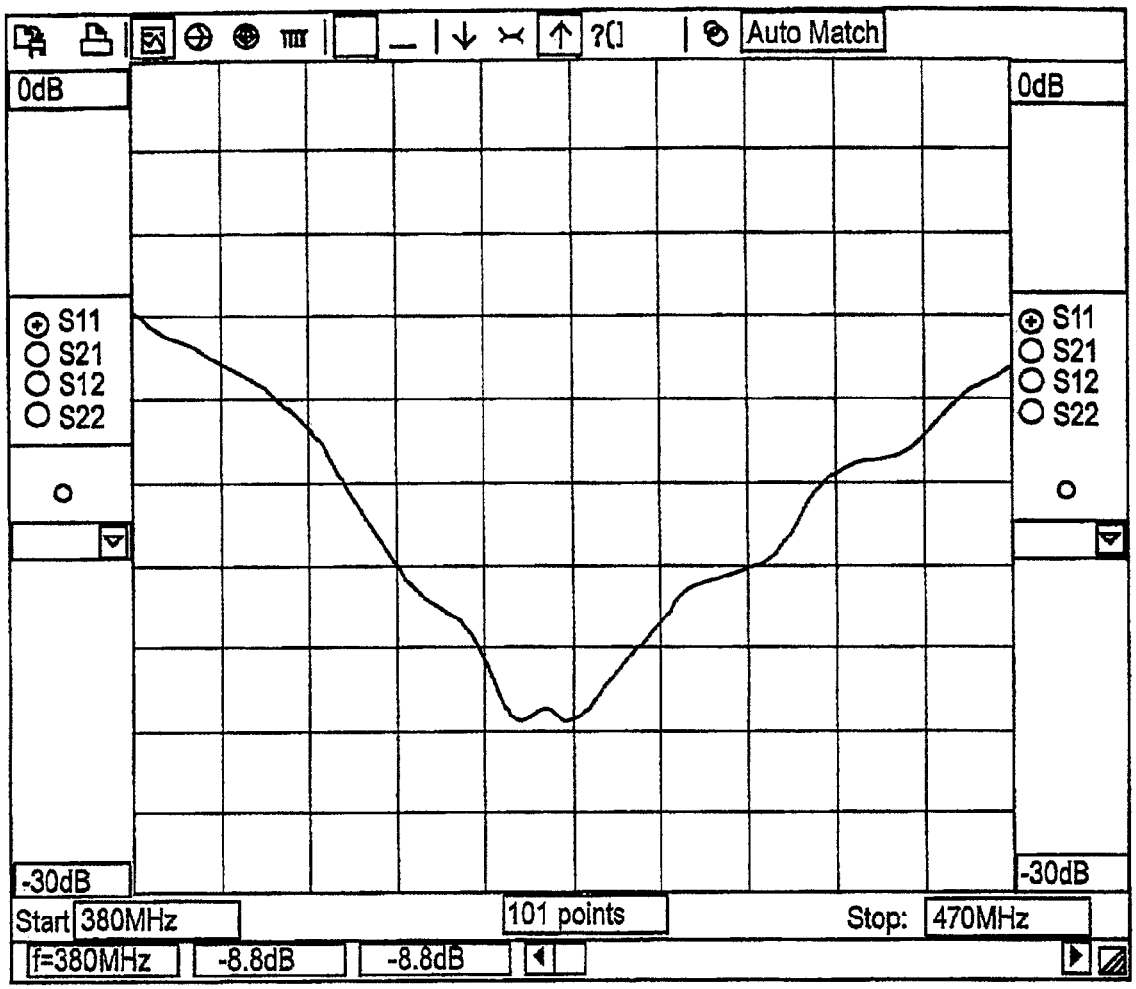
FIG. 40 is a graph of simulation results for the antenna of FIG. 39.

The simulation results for antenna return loss for the antenna of FIG. 39 are shown in FIG. 40.

Depending on the desired frequency range, the circuit component 32 can include lumped or pseudo-lumped elements to realize the matching network.

In terms of topologies, we have at this time successfully integrated in this connector diverse low-pass and band-pass configurations with the objective to increase the selectivity of an antenna (fifth order band-pass filter) or increase the bandwidth of the antenna (third order low-pass and band-pass filters). Other applications include the integration of active devices or wide-band baluns.

A) UHF Wide-Band Antenna:

In order to complete our study, we created two antennas in the UHF frequency band of different lengths. Each type of antenna was tested with a matching network and without a matching network, and thus there are four sets of results. By creating wide-band antennas in this frequency band, we will try to define the increase of efficiency linked to the increase of bandwidth.

Figure 41:
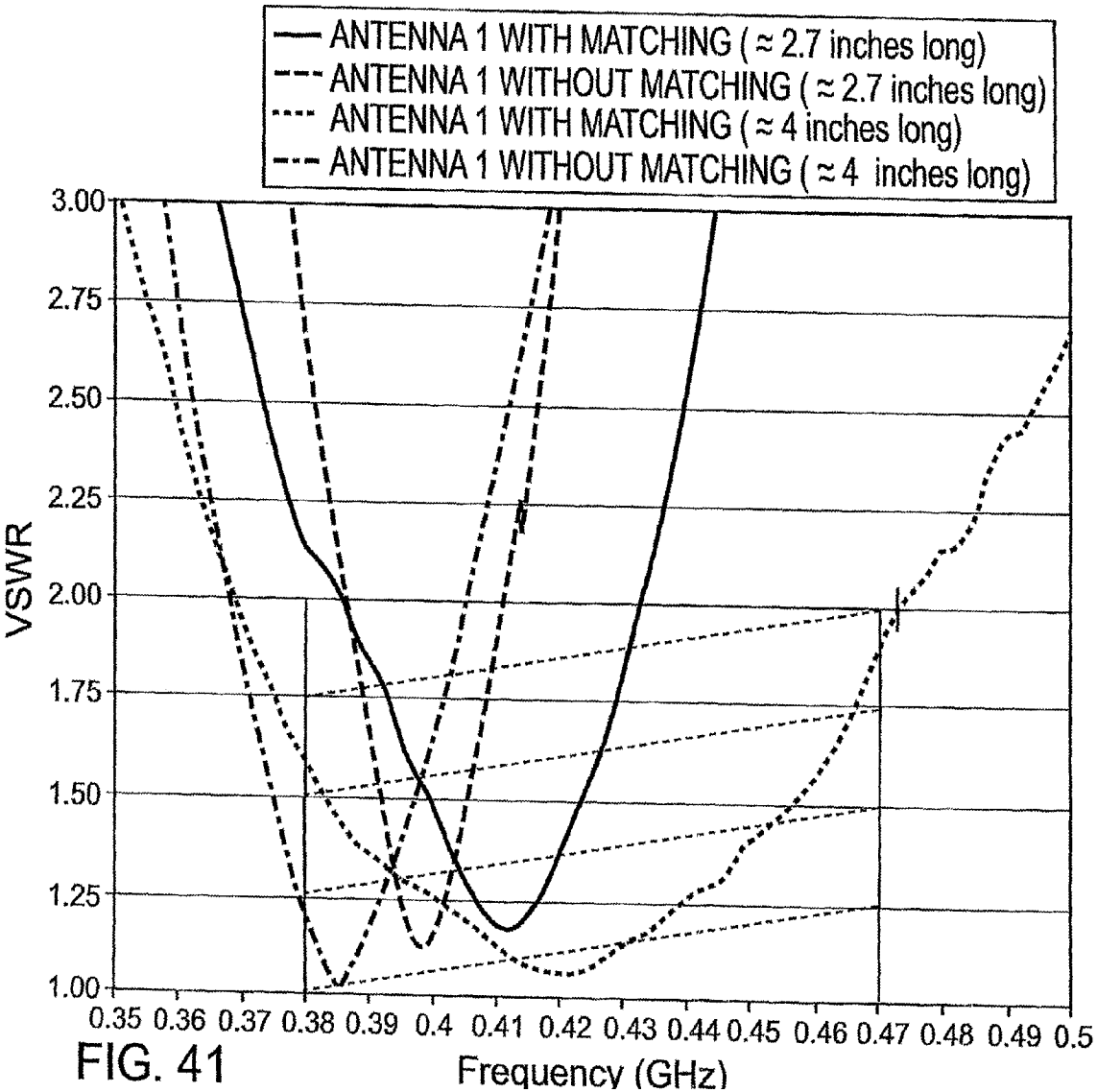
FIG. 41 is a graph of frequency vs. VSWR showing the individual curves obtained for four different antennas.
Figure 42:
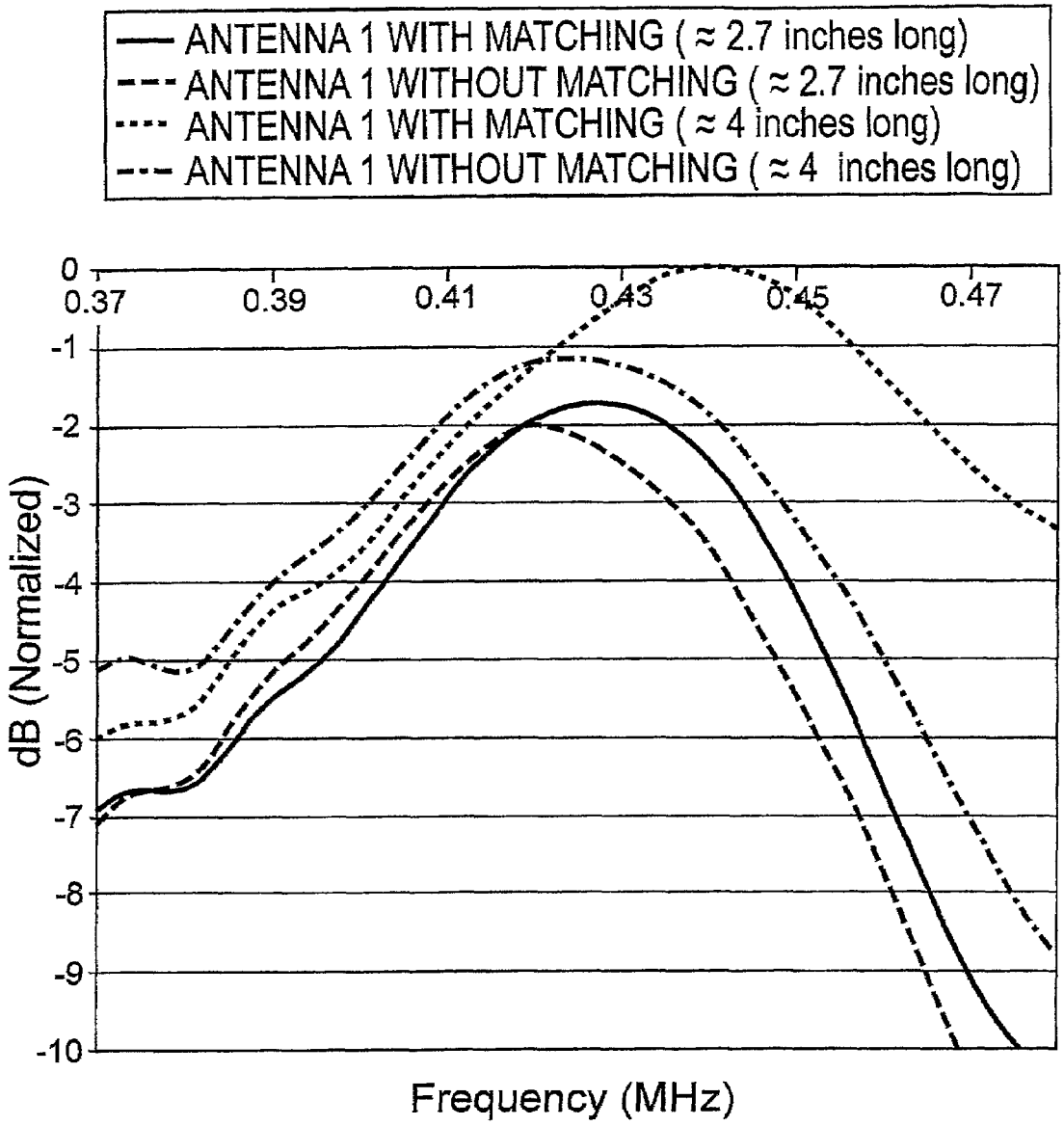
FIG. 42 is a graph of frequency vs. Gain for the same four antennas of FIG. 41.

In a first step, we have measured the four sets of results to measure the VSWR and the Gain in one direction of space for each solution. FIG. 41 is a graph of frequency vs. VSWR showing the individual curves obtained for the four sets of results. FIG. 42 is a graph of frequency vs. gain for the same four antennas.

With the introduction of a matching network, the bandwidth of the antenna is increased in terms of impedance. Referring to FIG. 41, the bandwidth is easily doubled for a VSWR of 2.0:1.

Referring to FIG. 42, although the results show that the antennas with matching generally have higher gain across the frequency range than the respective comparison antennas without matching, in a particular direction any increase of the radiation bandwidth or efficiency is difficult to define for gain with this type of measurement, due to the variation in length between the antennas being compared.

FIGS. 43 and 44 are tables showing the percent of bandwidth for which VSWR is less than or equal to 2.0:1 and for which the gain is −3 dB. FIG. 43 shows the results for the first antenna, and FIG. 44 shows the results for the second antenna.

This type of structure will not modify the radiation characteristic of a helical monopole. The radiation characteristic of the helical monopole is generally only sensitive to the dimensions of the antenna. This means that in order to obtain in one direction of propagation a maximum of radiated energy in the complete bandwidth, one needs to optimize the ratio of (Length of the antenna+terminal)/wavelength. This phenomena is illustrated, e.g., by the results shown in FIG. 42 for antennas of different lengths, and we could see that with a small increase of 1 inch, the peak gain in one direction has increased by 1.1 dB and the −3 dB radiation bandwidth has increased by 5 MHz.

The following table shows the main relations existing between the various electrical and mechanical parameters:

| | VSWR | Peak Gain | Radiation bandwidth |
|---|---|---|---|
| Length | ↑↑ | ↑↑ | ↑↑ |
| Diameter | ↑ | = | ↑ |

B) VHF Wide-Band Antennas:

For this application, we have designed two types of 6-inch long antennas with matching networks.

Selective Antenna:

The first type of antenna was designed to show the capability of increasing the out of band rejection by integrating a high order band-pass filter in the antenna.

Objective: Increase the out of band rejection of the antenna.

Process: Integration of a high order band-pass filter in the connector.

An outdoor measurement was made to show the capability of the structure. This method gives a good idea of the results, but appears to be very sensitive to the environment.

Figure 45:
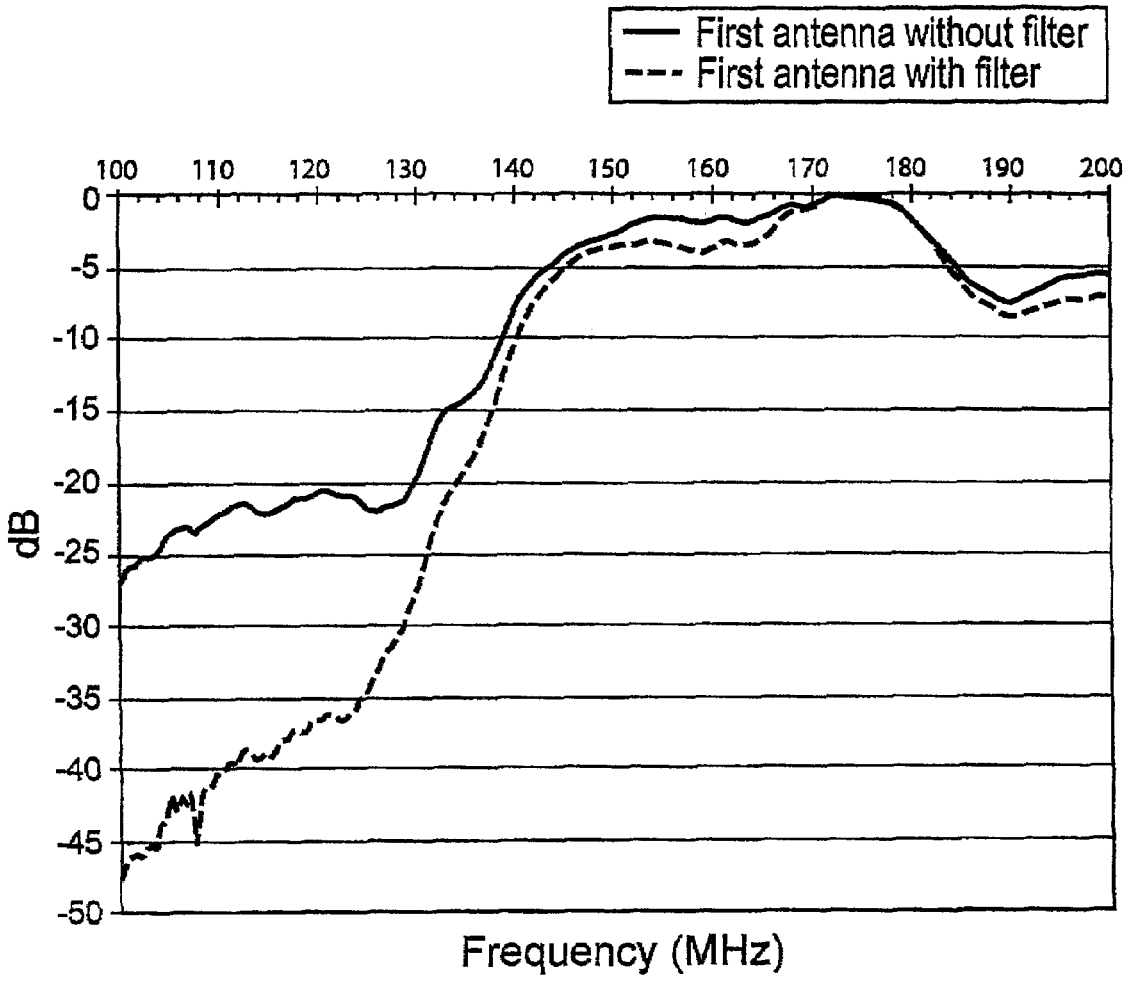
FIG. 45 is a graph of frequency vs. Gain for a first antenna in two states, i.e., with a filter and without a filter.

The out of band rejection improvement is shown in FIG. 45 for the first antenna in two states, i.e., with and without the filter. As shown for this example, the filter has been optimized on the low part of the band and it appears very easy to move the rejected portion of the band to different parts of the bandwidth by tuning the differential resonator of the band-pass filter. By modifying the order of the filter and by adjusting the frequency, selectivity could be chosen with a low impact on the efficiency of the structure.

Wide-Band Antenna:

The objective for the second type of antenna was to present a VSWR lower than 2.0:1 in the complete VHF bandwidth (136 to 174 MHz), i.e., to increase the usable bandwidth, by using a filter topology currently used for military applications.

Objective: Increase the bandwidth of the antenna.

Process: Integration of an optimized filter in the connector.

Figure 46:
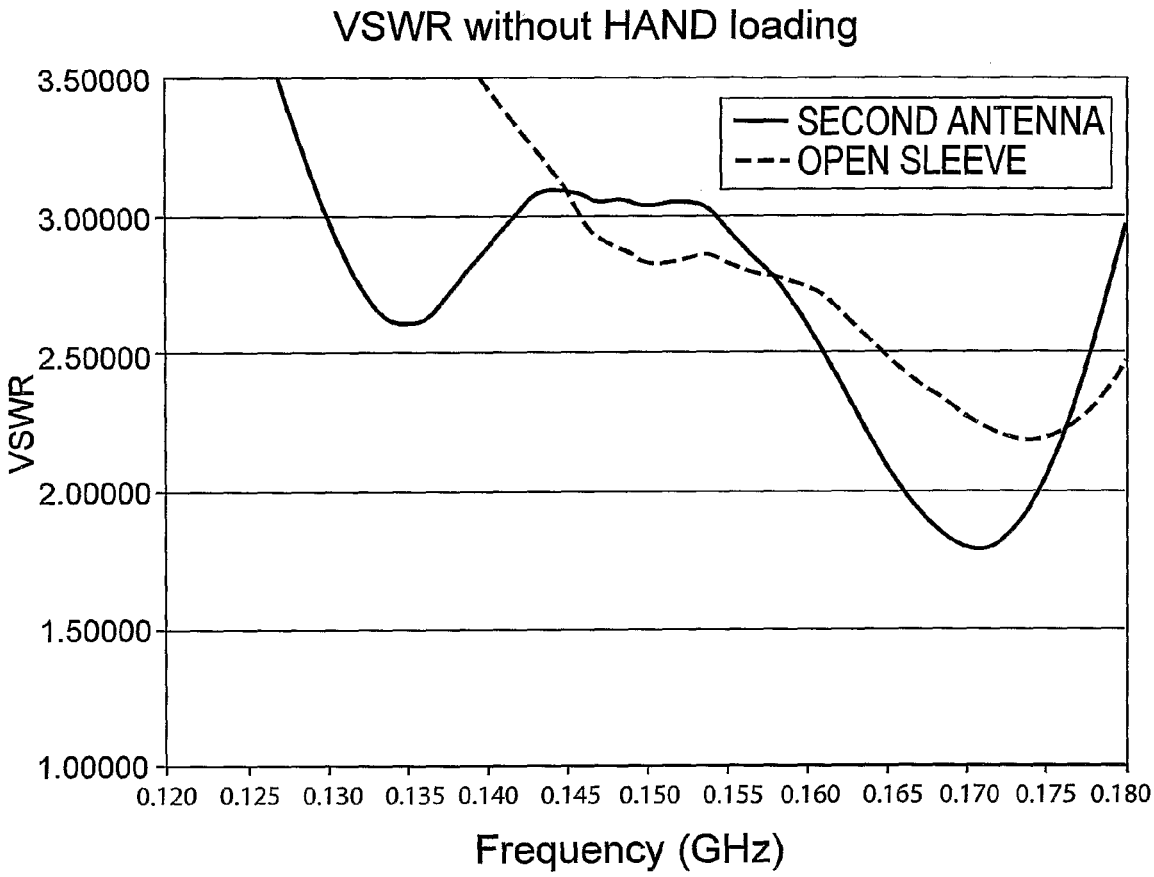
FIG. 46 is a graph of frequency vs. VSWR for a second antenna, also showing a conventional antenna for comparison.

A VSWR measurement has been made to show the capability of the structure. Referring to FIG. 46, which is a graph of frequency vs. VSWR, the results for the antenna of the second type ("second antenna") are shown together with the results for a conventional open sleeve wide-band VHF antenna. The conventional antenna is at this time 1 inch longer than the second antenna and is average diameter is a little bit larger than the second antenna.

Still referring to FIG. 46, without the effects of loading coming from the hand, the two antennas perform differently and the second antenna provides a better VSWR than the conventional antenna on the test terminal.

Figure 47:
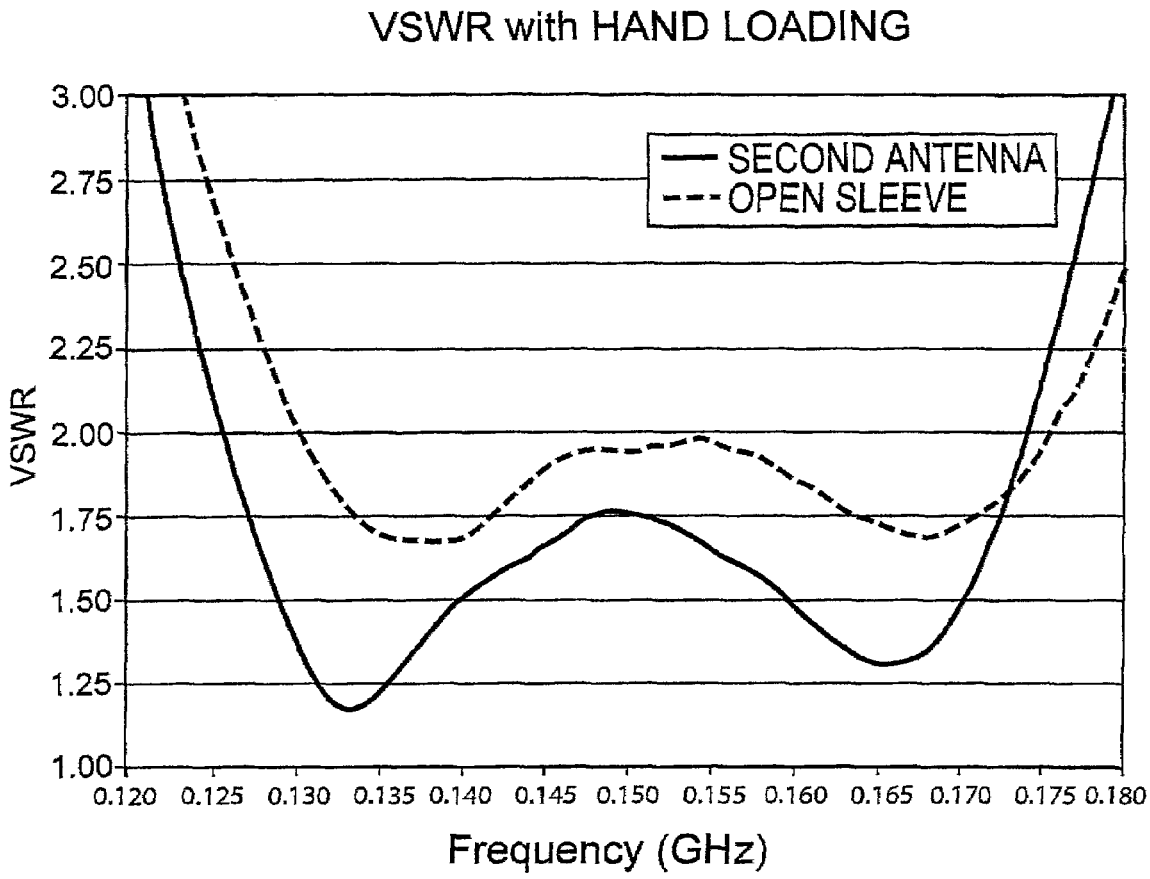
FIG. 47 is a graph of frequency vs. VSWR similar to FIG. 46, except showing the effect of hand loading.

FIG. 47 is a graph similar to FIG. 46, except showing the effect of hand loading. With the hand on the terminal, the two antennas offer a VSWR lower than 2.0:1 on the complete bandwidth, but the second antenna offers a broader match than the conventional antenna.

Figure 48:
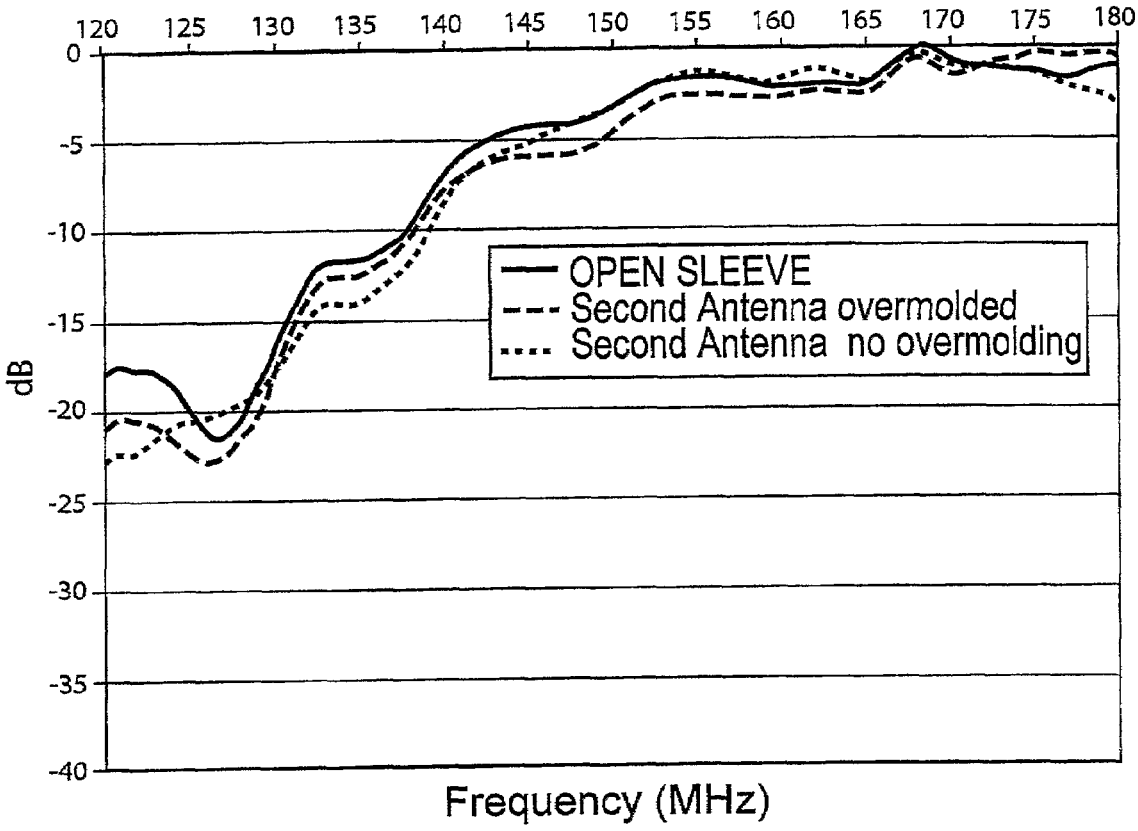
FIG. 48 is a graph of frequency vs. Gain for the second antenna configured in an overmolded state and in a state with no overmolding.

Referring to FIG. 48, in an outdoor setting a difference of approximately 0.8 dB exists between the two antennas in transmission radiation. The difference in length between the second antenna and the conventional antenna could explain the difference in levels observed in the low part of the band. To verify this observation, the second antenna was measured both in its overmolded state and without overmolding. Even though the second antenna without overmolding is about 0.5 in shorter, the difference in gain when compared to the second antenna with overmolding is not appreciable.

Figure 49:
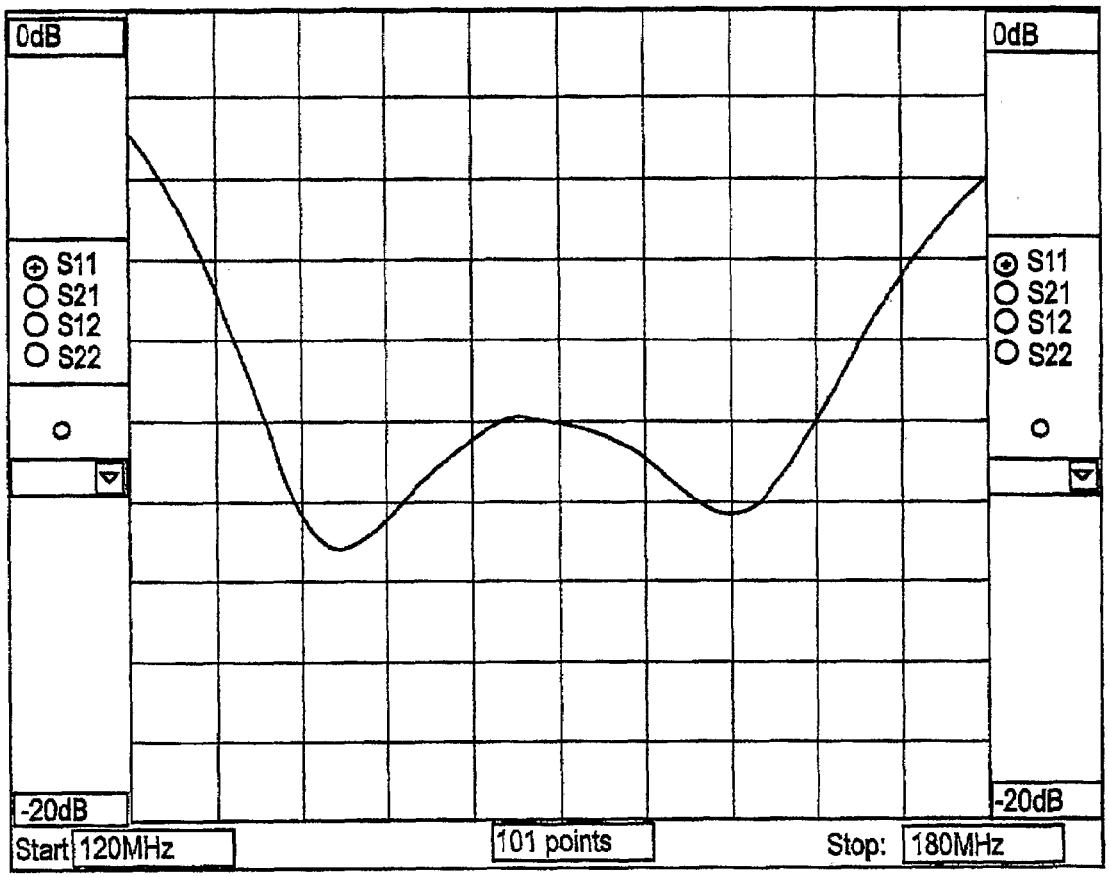
FIG. 49 is a graph of simulation results showing frequency vs. VSWR for the second antenna under simulated conditions.

FIG. 49 is a graph of frequency vs. VSWR for the second antenna under simulated conditions. Comparing the curves for the second antenna in FIG. 47 and in FIG. 49, it can be seen that there is good agreement between the actual results and the simulated results.

The built-in circuit component approach appears to be very convenient for the creation of wideband matching network for low frequency whip antennas, but could also be used to increase the out of band rejection of a low band structure. Due to its modularity and the option of using a no solder process, the connector with the built-in circuit component has also the advantage of speeding up the customization of whip antennas for any type of radio. The introduction of the filter allows the radio manufacturer to provide any values of impedance at the end of the RF card, and by that fact allows him to reduce the number of antennas able to be mounted on the manufacturer's terminal (alternative to a custom connector, FCC requirements). There are, of course, many other advantages to the built-in circuit approach.

IV—Multi-Band Whip Antennas—Potential Solutions:

The built-in circuit component has potential application in the field of UHF wide-band/GPS and/or VHF wide-band/GPS antennas.

The conventional wide-band solutions presented on the market are based on the open sleeve technology. Two resonators are associated in order to create two resonant poles in the frequency band (e.g., as in conventional open sleeve wide-band UHF antenna technology). The open sleeve could be considered as an open stub and does not interfere with the fundamental radiation of the structure. This type of topology has some merits, but increases the diameter of the antenna.

In addition, with an open sleeve structure the control of a third resonance at higher frequency appears to be very difficult. To obtain a multi-band configuration, it will be necessary to use a second open sleeve (three antennas) or to perfectly control the high of all resonators in order to work on a higher mode.

In contrast, the built-in circuit component approach described herein allows the use of a single resonator to obtain the bandwidth and also the capability to control the impedance offer many more possible solutions to create and control a high frequency resonance. In addition, this approach still allows for introducing another open sleeve to create another resonance.

In addition to the embodiments described above, including coaxial cable, edge card and cable assembly interfaces, the built-in circuit component approach could be implemented for other types of mounting of the connector, antenna or even a cable having the built-in component. It is also possible to configure the connector for use in MIMO (Multiple Input Multiple Output) applications.

Figure 50:
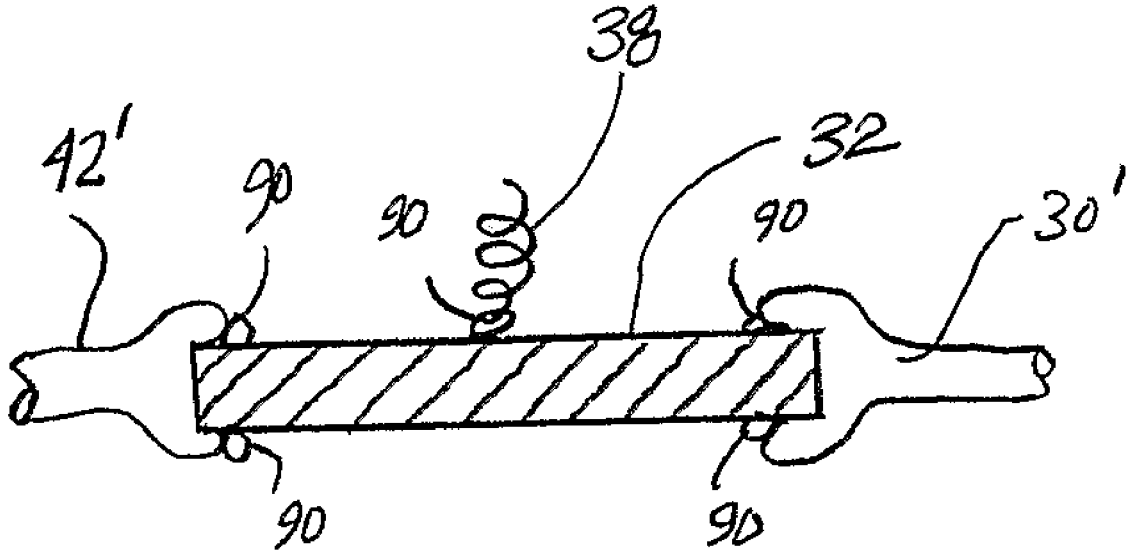
FIG. 50 is a schematic representation of a circuit component showing soldered connections, a modified contact and a modified pin.

In the above embodiments, the built-in circuit component is implemented using solder-free connections that are maintained by a close fit and/or resilient force with adjacent components, e.g., the fit of the circuit component 32 with the contact 42 at one end, with the pin 30 at the other end and with the spring contact 38. In other embodiments, such as shown in FIG. 50, these connections to the circuit component may implemented with soldered connections or other type of connections. For example, as shown in FIG. 50, the circuit component 32 can be attached by a soldered connection 90 to a modified contact 42' and to a modified pin 32'. The modified contact 42' and/or the modified pin 32' can be shaped with a groove or pocket for receiving the circuit component 32. Similarly, there can be a solder connection 90 between the spring contact 38 and the circuit component 32.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

What is claimed is:

1. An antenna assembly with an integral circuit component housing assembly and circuit component, the antenna assembly comprising:

an antenna;

a circuit component housing extending from one end of the antenna and having an opposite free end, a body with a generally enclosed exterior surface extending between the free end and the antenna, and a coaxial-type connection at the free end, the coaxial-type connection having a contact generally aligned with an axis of the body and having an outer portion radially spaced from the contact, the coaxial-type connection allowing the assembly to be coupled to a corresponding coaxial-type connection of a device or cable;

an insulator received in an interior space defined within the body, the insulator comprising a side portion extending at least a portion of a length of the body, a hollow interior, and a side opening in the side portion;

a circuit component received in the interior space defined within the body, the circuit component having electrical connections to the contact and to the antenna, wherein the circuit component housing provides electromagnetic shielding from the antenna for the circuit component; and a ground connection between the body and the circuit component, the ground connection comprising a conductive spring contact extending at least partially through the side opening of the insulator.

2. The assembly of claim 1, wherein the circuit component includes an antenna matching circuit.

3. The assembly of claim 1, wherein the circuit component includes an amplifier circuit.

4. The assembly of claim 1, wherein the circuit component includes an attenuator circuit.

5. The assembly of claim 1, wherein the circuit component includes a splitter circuit.

6. The assembly of claim 1, wherein the circuit component includes a diplexer circuit.

7. The assembly of claim 1, wherein the circuit component includes a filtering circuit.

8. The assembly of claim 1, wherein the circuit component includes at least a portion configured as an integrated circuit.

9. The assembly of claim 1, wherein the circuit component includes at least a portion configured as a printed circuit board.

10. The assembly of claim 1, wherein the contact is a socket contact dimensioned to receive a center conductor of a corresponding coaxial cable.

11. The assembly of claim 10, wherein the outer portion of the coaxial-type connection defines an outer periphery of the free end.

12. The assembly of claim 11, wherein the outer portion is electrically isolated from the contact.

13. The assembly of claim 12, further comprising an insulator radially separating the contact and the outer portion.

14. The assembly of claim 1, wherein the contact is a first contact, wherein the body further comprises a second contact, and wherein the second contact has an inner end shaped to contact the circuit component and an outer end in communication with the antenna.

15. The assembly of claim 1, wherein the antenna comprises a helical-shaped antenna element.

16. The assembly of claim 1, wherein the contact is a first contact, wherein the body further comprises a second contact, and wherein the second contact is electrically isolated from the first contact except for an electrical connection to the first contact established through the circuit component when the circuit component is assembled in series between the first contact and second contact.

17. The assembly of claim 16, wherein the first and second contacts comprise soldered connections to the circuit component.

18. The assembly of claim 1, wherein the circuit component housing has a generally elongated shape and a generally circular cross section.

19. The assembly of claim 1, wherein the circuit component can be installed in and removed from the housing without the use of a tool when the antenna assembly is assembled.

20. The assembly of claim 1, wherein the circuit component includes at least one capacitor.

21. The assembly of claim 1, wherein the circuit component includes at least one inductor.

22. The assembly of claim 1, wherein the contact is a first contact, wherein the circuit component housing comprises a second contact, and wherein the circuit component has ends shaped to receive the first contact and the second contact.

23. The assembly of claim 1, wherein the coaxial-type connection comprises an edge card interface for coupling the assembly to an edge of a card.

24. The assembly of claim 1, wherein the contact has a central bore shaped to receive a conductor of a coaxial cable that can be extended to contact the circuit component within the housing.

25. The assembly of claim 1, wherein at least a portion of the housing is conductive and substantially encompasses the circuit component.

26. The assembly of claim 1, further comprising an overmolding section covering at least a portion of the antenna and at least a portion of the circuit component housing.

27. The assembly of claim 1, wherein the antenna comprises a whip antenna element.

28. The assembly of claim 1, wherein the conductive spring contact exerts a biasing force against the circuit component.

29. An antenna assembly having an integral antenna connector segment, comprising:

an antenna;

an antenna connector segment extending from one end of the antenna and having an opposite free end with a coaxial-cable type connection capable of connecting the antenna assembly to a device or cable, the antenna connector comprising a body having a generally enclosed exterior surface extending between the free end and the antenna, the coaxial-type connection having a contact generally aligned with an axis of the body and an outer portion radially spaced from the contact;

a circuit component received in an internal space defined within the body, the circuit component having electrical connections to the contact and to the antenna, the circuit component having a resonator capable of achieving a wide-band frequency response;

a ground connection between the body and the circuit component by which the circuit component is grounded; and a hollow tubular insulator configured to fit within the body between the outer portion and the contact, the internal space comprising a generally axial slot formed in the insulator, and the insulator having a side surface through which an opening for the ground connection from the circuit component to the body is defined.

* * * * *